United States Patent [19]

Strong et al.

[11] 4,051,331

[45] Sept. 27, 1977

[54] SPEECH CODING HEARING AID SYSTEM UTILIZING FORMANT FREQUENCY TRANSFORMATION

[75] Inventors: William James Strong; Edward Paul Palmer, both of Provo, Utah

[73] Assignee: Brigham Young University, Provo, Utah

[21] Appl. No.: 671,420

[22] Filed: Mar. 29, 1976

[51] Int. Cl.[2] ..... G10L 1/00

[52] U.S. Cl. ..... 179/107 R; 179/1 SH; 179/15.55 R; 179/1 SA

[58] Field of Search ..... 179/1 SA, 15.55 R, 15.55 T, 179/107 R, 107 FD, 1 SH

[56] References Cited

U.S. PATENT DOCUMENTS

| | | | |
|---|---|---|---|
| 3,385,937 | 5/1968 | Lafon | 179/107 FD |
| 3,681,756 | 8/1972 | Burkhard et al. | 179/1 SA |
| 3,819,875 | 6/1972 | Velmans | 179/107 FD |
| 3,830,977 | 8/1974 | Dechaux | 179/1 SA |
| 3,875,341 | 4/1975 | Gassmann | 179/15.55 R |
| 3,909,533 | 9/1975 | Willimann | 179/1 SA |
| 3,946,162 | 3/1976 | Gassman | 179/1 SA |

OTHER PUBLICATIONS

Thomas I. and Flavin F.," The Intelligibility of Speech Transposed Downward," J. Audio Eng. Soc., Feb. 1970.

*Primary Examiner*—William C. Cooper
*Assistant Examiner*—E. S. Kemeny
*Attorney, Agent, or Firm*—Criddle, Thorpe & Western

[57] ABSTRACT

A hearing aid system and method includes apparatus for receiving a spoken speech signal, apparatus coupled to the receiving apparatus for determining at successive intervals in the speech signal the frequency and amplitude of the largest formants, apparatus for determining at successive intervals the fundamental frequency of the speech signal, and apparatus for determining at successive intervals whether or not the speed signal is voiced or unvoiced. Each successively determined formant frequency is divided by a fixed value, greater than 1, and added thereto is another fixed value, to obtain what are called transposed formant frequencies. The fundamental frequency is also divided by a fixed value, greater than 1, to obtain a transposed fundamental frequency. At the successive intervals, sine waves having frequencies corresponding to the transposed formant frequencies and the transposed fundamental frequency are generated, and these sine waves are combined to obtain an output signal which is applied to a transducer for producing an auditory signal. The amplitudes of the sine waves are functions of the amplitudes of corresponding formants. If it is determined that the speech signal is unvoiced, then no sine wave corresponding to the transposed fundamental frequency is produced and the other sine waves are noise modulated. The auditory signal produced by the transducer in effect constitutes a coded signal occupying a frequency range lower than the frequency range of normal speech and yet which is in the residual-hearing range of many hearing-impaired persons.

17 Claims, 3 Drawing Figures

SPEECH CODING HEARING AID SYSTEM UTILIZING FORMANT FREQUENCY TRANSFORMATION

BACKGROUND OF THE INVENTION

This invention relates to an auditory hearing aid and more particularly to a hearing aid system and method which utilizes formant frequency transformation.

Although the conventional hearing aid, which simply amplifies speech signals, provides some relief from many hearing impairments suffered by people, there are many other types of hearing impairments for which the conventional hearing aid can provide little, if any, relief. In the latter situations, it is recognized that an approach different from simple amplification is necessary, and a number of different approaches have been proposed and tested at least in part. See Strong, W. J., "Speech Aids for the Profoundly/Severely Hearing Impaired: Requirements, Overview and Projections", The Volta Review, December, 1975, pages 536 through 556. Most of the methods and devices proposed to date, however, have proven unsatisfactory for either reception of speech by or training of hearing-impaired persons for whom the conventional hearing aid can provide no relief.

Many hearing-impared persons who cannot be helped by the conventional hearing aid nevertheless have residual hearing typically in a frequency range at the lower end of the frequency range of normal speech. Recognizing this fact, several different types of frequency-transposing aids have been suggested in which high-frequency energy of a speech signal is mapped or transposed into the low-frequency, residual hearing region. One of the frequency transposing methods produces arithmetic frequency shifts downward but in so doing may destroy information in the frequency range of the first format of the speech signal by replacing it with information from higher frequencies. Other methods compress the entire speech frequency range into the residual hearing range using vocoding techniques. If only a few frequency channels are used in the vocoding, the frequency resolution is too coarse to capture essential speech information. If many channels are used, too many frequencies are compressed into the narrow frequency band of residual hearing and they cannot be resolved. In both cases, it is likely that speech discrimination would suffer. In still other related methods, selected high frequency bands are mapped down into selected low frequency regions. Apparent drawbacks of these methods are the destruction of perceptually important low frequency information, the mapping of perceptually unimportant information, and the mapping of fixed frequency bands whether the speech is that of a male, female, or child.

Other speech reception aids which have been suggested include tactile aids, in which speech information is presented to the subject's sense of touch, and visual aids, in which speech information is visually presented to a subject. The obvious drawback of tactile and visual aids, as compared to auditory aids, is that the former occupy and require use of one of the person's senses which might otherwise be free to accomplish other tasks.

SUMMARY OF THE INVENTION

It is an object of the present invention to provide a new and useful auditory aid for hearing-impaired persons having certain residual hearing.

It is another object of the present invention to provide a hearing aid system or method which analyzes speech and extracts from the speech signal those parameters which are most important in speech perception.

It is another object of the invention to not use parameters which are redundant and which, if transformed to low frequencies, would serve to mask the essential parameters and thus to degrade speech perception.

It is another object of the present invention to provide a hearing aid system and method which utilizes the most important speech parameters and transforms them from one frequency range to a lower frequency range to produce related speech signals which may be perceived by hearing-impaired persons.

Parameters most important to speech perception are taken to be formant frequencies and amplitudes, fundamental frequency, and voiced/unvoiced information. See Keeler, L. O. et al, "Comparision of the Intelligibility of Predictor Coefficient and Formant Coded Speech", paper presented at 88th meeting of the Acoustical Society of America, November, 1974. Accordingly, the above and other objects of the present invention are realized in an illustrative system embodiment which includes apparatus for receiving a vocal speech signal, apparatus coupled to the receiving apparatus for estimating the frequencies and amplitudes of $n$ formants of the speech signal at predetermined intervals therein, apparatus responsive to the estimating apparatus for producing oscillatory signals having frequencies which are some predetermined value less than the estimated frequencies of the formants, apparatus for combining the oscillatory signals to produce an output signal, and a transducer for producing an auditory signal from the output signal. In accordance with one aspect of the invention, the frequencies of the oscillatory signals are determined by dividing the estimated format frequencies by some predetermined value. In accordance with another aspect of the invention, the system includes apparatus for detecting whether or not a speech signal is voiced or unvoiced and apparatus using noise in lieu of at least certain of the oscillatory signals if the speech signal is determined to be unvoiced. In this manner, essential information in a speech signal which is out of the frequency range which can be heard by a hearing-impaired person is transformed or transposed into a frequency range which is within the hearing range of the person.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Before describing the illustrative embodiments of the present invention, a brief description will be given of vocal speech signals and the techniques for representing such signals. For a more detailed and yet fairly elementary discussion of speech production, hearing and representation, see Denes, P. B. and Pinson, E. N., *The Speech Chain,* published by Anchor Books, Doubleday and Co. Sound waves or speech signals produced by a person's vocal organs consist of complex wave shapes which can be represented as the sum of a number of sinusoidal waves of different frequencies, amplitudes and phases. These wave shapes are determined by the vocal cords (voiced sound) or by turbulent airflow (unvoiced sound), and by the shape of what is called the vocal tract, consisting of the pharynx, the mouth and the nasal cavity, as modified by the tongue, teeth, lips and soft palate. The vocal organs are controlled by a person to produce different sounds and combinations of sounds necessary for spoken communication.

Figure 1:
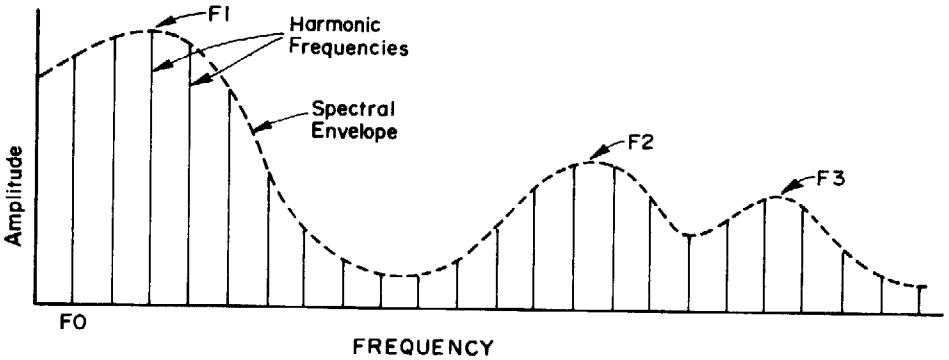
FIG. 1 shows an exemplary frequency spectrum of a speech sound or signal, with the first three formants of the signal indicated.

A voiced speech wave may be represented by an amplitude spectrum (or simply spectrum) such as shown in FIG. 1. Each sinusoidal component of the speech wave is represented by a vertical line whose height is proportional to the amplitude of the component. The fundamental vocal cord frequency $F_o$ is indicated in FIG. 1 as being the first vertical line, moving from left to right in the graph, with the remaining vertical lines representing harmonics (integer multiples) of the fundamental frequency. (The higher the frequency of a component, the further to the right is the corresponding vertical line.) The dotted line connecting the tops of the vertical lines represents what is referred to as the spectral envelope of the spectrum. As indicated in FIG. 1, the spectral envelope includes three peaks, labeled F1, F2 and F2 and these are known as formants. These formants represent frequencies at which the vocal tract resonates for particular speech sounds. Every configuration or shape of the vocal tract has its own set of characteristic formant frequencies, so most distinguishable sounds are characterized by different formant frequencies. It will be noted in FIG. 1 that the frequencies of the formant peaks do not necessarily coincide with any of the harmonics. The reason for this is that formant frequencies are determined by the shape of the vocal tract and harmonic frequencies are determined by the vocal cords.

The spectrum represented in FIG. 1 is for a periodic wave (appropriate for voiced speech), one in which the frequency of each component is a whole-number multiple of a fundamental frequency. Aperiodic waves (typical of unvoiced speech) can have component at all frequencies rather than just at multiples of a fundamental frequency and thus aperiodic waves are not represented by a graph consisting of a plurality of equally spaced vertical lines. Rather, a smooth curve similar to the spectral envelope of FIG. 1 could be used to represent the spectrum of an aperiodic wave wherein the height of the curve at any frequency would represent the energy or amplitude of the wave at that frequency.

The graph of FIG. 1 shows a spectrum having three readily discernible formants. However, other spectra may have a different number of formants and the formants may be difficult to resolve in cases where they are close together in frequency.

One other aspect of speech production and analysis should be further clarified here and that is the aspect of voiced, unvoiced and mixed speech sounds. Unvoiced or fricative speech sounds such as s, sh, f, etc., and the bursts such as t, p, etc., are generated by turbulent noise in a constricted region of the tract and not by vocal cord action, whereas voiced speech sounds, such as the vowels, are generated by vocal cord action. Some sounds such as z, zh, b, etc., include both the vocal-cord and frictive-produced sound. These are referred to as mixed sounds. It is apparent that unvoiced sounds carry information just as do the voiced sounds and therefore that utilization of the unvoiced sound would be valuable in generating a code for hearing-impaired persons. With the arrangements to be described, this is possible since the spectra of fricative speech sounds, although irregular and without well-defined harmonics, do exhibit spectral peaks or formants.

The illustrative embodiments of the present invention utilize a variety of well known signal processing and analyzing techniques, but in a heretofore unknown combination for producing coded auditory speech signals in a frequency range perceivable by many hearing impaired persons. It is contemplated that the system to be described will be of use as a prosthetic aid for the so-called severely or profoundly hearing-impaired person. Although there are a number of ways of implementing the system, each way described utilizes a basic method of estimating formant frequencies of speech signals and transforming those frequencies to a lower range where sine waves (or narrow band noise) having frequencies equal to the transformed formant frequencies are generated and then combined to produce a coded speech signal which lies within the range of residual hearing of certain hearing-impaired types of persons of interest.

Figure 2:
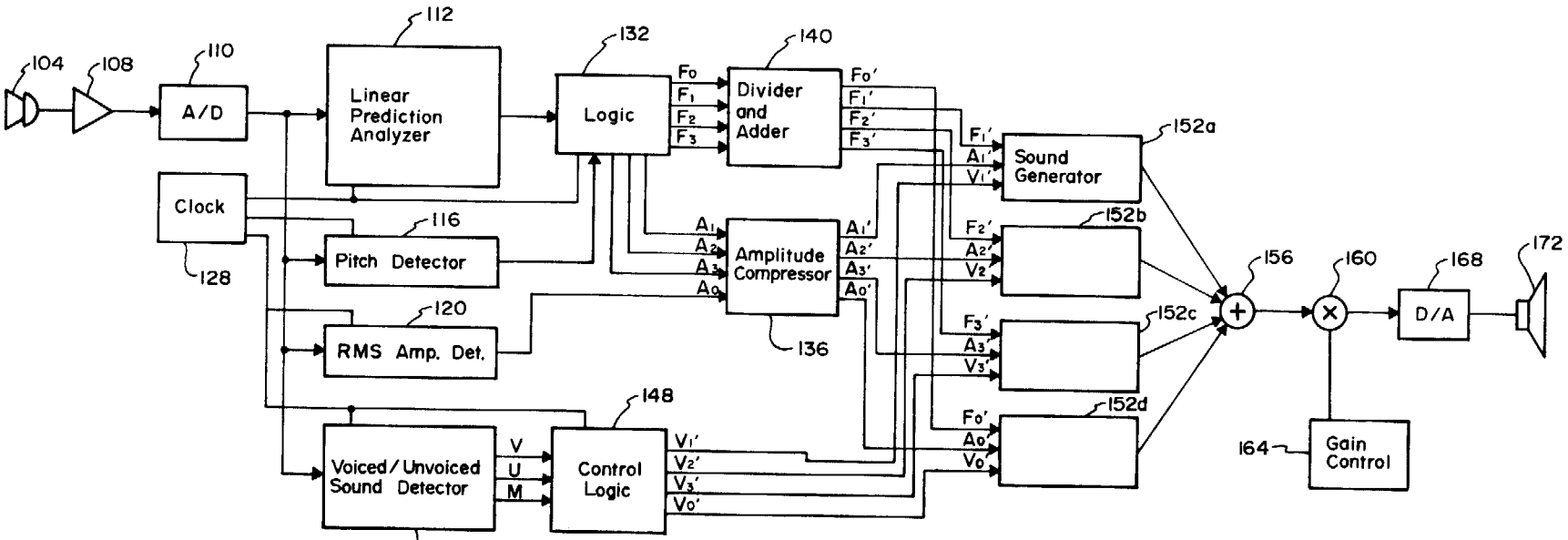
FIG. 2 is a schematic of a digital hearing aid system made in accordance with the principles of the present invention.

Referring now to FIG. 2 there is shown a digital implementation of the system of the present invention. Included are a microphone 104 for receiving a spoken speech signal, and an amplifier 108 for amplifying the signal. Coupled to the amplifyer is an analog to digital converter 110 which converts the analog signal to a digital representation thereof which is passed to a linear prediction analyzer 112, a pitch detector 116, an r.m.s. amplitude detector 120, and a voiced/unvoiced sound detector 124. The linear prediction analyzer 112 processes the digital information from the analog to digital converter 110 to produce a spectral envelope of the speech signal at intervals determined by a clock 128. Hardware for performing linear prediction analysis is well known in the art and might illustratively include the MAP processor produced by Computer Signal Processors, Inc.

Figure 3:
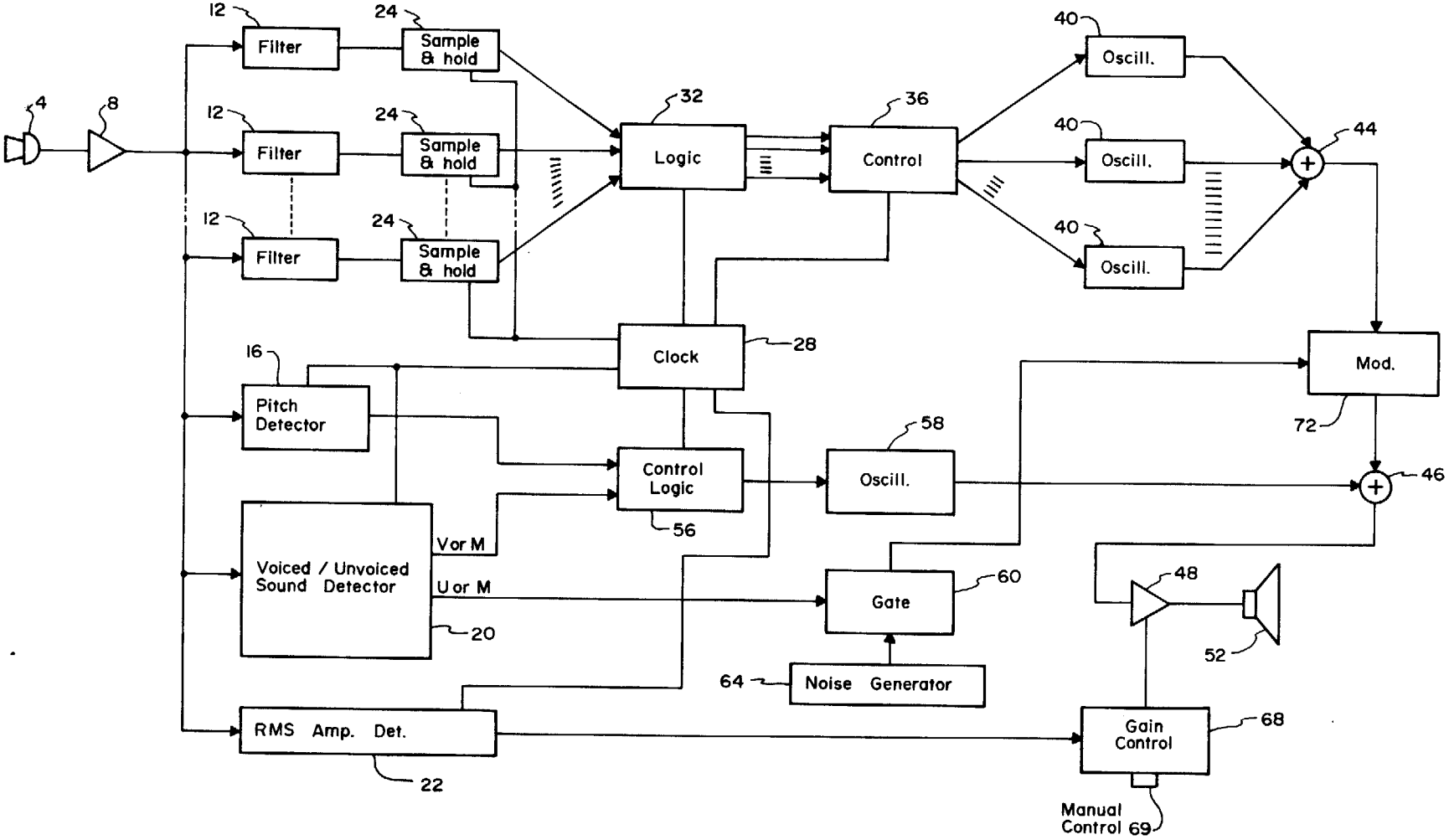
FIG. 3 is a schematic of an analog hearing aid system made in accordance with the principles of the present invention.

The digital information produced by the analyzer 112 and representing the spectral envelope of the speech signal is applied to a logic circuit 132 which picks the formant peaks from the supplied information. That is, the amplitudes $A_n$ and the frequencies $F_n$ for the $n$ largest formants are determined and then the amplitude information is supplied to an amplitude compressor 136 and the frequency information is supplied to a divider and adder 140. (It should be understood that formants other than the $n$ largest might also be used—for example, the $n$ formants having the lowest frequency. Normally, the $n$ largest will be the same as those having the lowest frequency.) Logic circuits suitable for performing the logic of circuit 132 of FIG. 3 are also well known and commercially available. For example, see *The T.T.L. Data Book, Components Group, Market Communications,* published by Texas Instruments, Inc., and Christensen et al, "A comparison of Three Methods of Extracting Resonance Information from Predictor-Coefficient Coded Speech", IEEE Transactions on Acoustics, Speech, and Signal Processing, February, 1976.

The pitch detector 116 determines the fundamental frequency $F_o$ of the speech signal at the timing intervals determined by the clock 128, and supplies this information to the logic circuit 132 which then supplies the information to the divider and adder circuit 140. Pitch detectors are well known in the art.

The r.m.s. amplitude detector 120, at each timing interval, determines the r.m.s. amplitude $A_o$ of the input speech signal and applies this information to the amplitude compressor 136. The detector 120 might illustratively be a simple digital integrator.

The voiced/unvoiced sound detector 124 receives the digital representation of the speech signal from the analog to digital converter 112 and determines therefrom whether or not the speech signal being analyzed is voiced (V), unvoiced (U), or mixed (M), in the latter case including both voiced and unvoiced components. A number of devices are available for making such a determination including digital filters for detecting noise in high frequency bands to thereby indicate unvoiced speech sounds, and the previously discussed pitch detectors. The sound detector 124 applies one of three signals to a control logic circuit 148 indicating that the speech signal in question is either voiced, unvoiced or mixed. The control logic 148, which is simply a decoder or translator, then produces a combination of control signals $V'_o$ through $V'_3$. The nature and function of these control signals will be discussed momentarily.

The frequency information supplied by the logic circuit 132 to the divider and adder 140 is first divided by the circuit 140 and then, advantageously, added thereto is a fixed value to produce so-called transformed frequencies $F'_o$, $F'_1$, $F'_2$ and $F'_3$ corresponding to a reduced fundamental frequency and reduced formant frequency respectively. Illustratively, the formant frequencies $F_n$ would be divided by some value greater than one, for example, a value of from two to six. The value would be selected for the particular hearing-impaired user so that the transformed frequencies would be in his residual hearing range. The fundamental frequency $F_o$ would, illustratively, be divided by some value less than the value used to divide the formant frequencies. The reason for this is that the fundamental frequency is generally quite low to begin with so division of the frequency by too high a number would place the frequency so low that the hearing-impaired person could not hear it. To insure that division of the formant frequencies does not place the resulting frequencies in a range below that which can be heard by a hearing impaired person, some fixed number may be added to the values obtained after dividing. The value added to the divided formant frequencies advantageously is about 100 $H_z$. This process of dividing down the formant and fundamental frequencies maps the normal formant and fundamental frequency range (about 0–5 $kH_z$) into the frequency range of residual hearing (about 0–1 $kH_z$) for many hearing-impaired persons.

The amplitude information supplied by the logic circuit 132 and r.m.s. amplitude detector 120 to the amplitude compressor 136 is in a somewhat similar fashion reduced to produce "compressed" amplitudes $A'_o$, $A'_1$, $A'_2$, and $A'_3$. This reduction or compression would involve the simple division of the input amplitudes by some fixed value and then the adding to the resultant of another fixed value. It may be desirable to compress each of the formant amplitudes differently or by a different amount and this would be accomplished simply by dividing each formant amplitude by a different divider. The choice of dividers would be governed, in part, by the need for maintaining the resulting amplitudes at levels where they can be heard by the hearing-impaired user in question, while at the same time maintaining some relative separation of the resulting amplitudes to reflect the relative separation of the corresponding estimated formant amplitudes.

The transformed frequencies produced by the divider and adder 140, the transformed amplitudes produced by the amplitude compressor 136 and the control information produced by the control logic circuit 148 are applied to corresponding sound generators 152 to which the signals are applied as indicated by the lables on the input leads of the sound generators. Thus, for example, transformed formant frequency $F'_1$ for the first formant is applied to the sound generator **152*a*, the transformed amplitude $A'_1$ of the first formant is also supplied to sound generator 152*a* and a control signal $V'_1$ is applied to that sound generator. The sound generators 152 are simply a combination of an oscillator and noise generator adapted to produce either a digital representation of an oscillatory sine wave or of a narrow band noise signal as controlled by the inputs thereto. Whether or not a noise or sine wave signal is produced by each sound generator 152 is determined by the control logic 148. The frequency of the sine wave signal or the center frequency of the noise signal produced by the sound generators are determined by the frequency information received from the divider and adder 140. The amplitudes of the signals produced by the sound generators are determined by the amplitude information received from the amplitude compressor 136**.

If the control logic 148 receives an indication from the detector 124 that the speech signal in question is voiced, it produces output control signals which will cause all of the sound generators 152 to generate sine wave signals having frequencies and amplitudes indicated respectively by the divider and adder 140 and amplitude compressor 136. Thus, the sound generator 152a would produce a sine wave signal having a frequency $F'_1$ and amplitude of $A'_1$, etc. If the sound detector 124 indicates to the control logic circuit 148 that the speech signal is unvoiced, then the control logic 148 applies control signals to the sound generators 152 to cause all of the sound generators except sound generator **152*d* to produce noise signals. The sound generator 152*d* receives a control signal from the control logic 148 to produce no signal at all. Finally, if the sound detector 124 indicates that the speech signal in question is mixed, the control logic 148 signals the sound generators to cause generators 152*a* and 152*d* to produce sine wave signals and generators 152*b* and 152*c* to produce noise signals. In this manner, information as to whether the speech signal is voiced, unvoiced or mixed is included in the transformed formant information to be presented to the hearing-impaired person. Of course, other combinations of control signals could be provided for causing the sound generators 152** to produce different combinations of noise or sine wave outputs.

The outputs of the sound generators 152 are applied to a digital summing circuit 156 where the outputs are combined to produce a resultant signal which is applied to a multiplier 160. A gain control circuit 164 is manually operable to cause the multiplier 160 to multiply the signal received from the summing circuit 156. The system user is thus allowed to control the average volume of the output signal so as to produce signal levels compatible with his most comfortable listening level. The multiplier circuit 160 applies the resultant signal to a digital to analog converter 168 which converts the signal to an analog equivalent for application to an acoustical transducer 172.

An alternative digital implementation of the system of the present invention is similar to that shown in FIG. 2 with the exception that the linear prediction analyzer is replaced with a fast Fourier transform analyzer which produces spectra of the speech signal, and the logic circuit 132 is adapted to pick the spectral peaks from the spectra to provide formant estimates.

FIG. 3 shows an analog implementation of the present invention. Again included are a microphone 4 for receiving and converting an acoustical speech signal into an electrical signal which is applied to an amplifier 8. The amplifier 8 amplifies the signal and then applies it to a bank of filters 12, to a pitch detector 16, to a voiced/unvoiced detector 20 and to a r.m.s. amplitude detector 22. Advantageously, the filters 12 are narrow-band filters tuned to span a frequency range of from about 80 $H_z$ to about 5000 $H_z$, which represents a range partly outside the hearing of many hearing-impaired persons. Of course, the frequency range spanned by the bank of filters 12 could be selected according to the individual needs of each hearing-impaired person served. Each filter 12 might illustratively be tuned to detect frequencies 40 $H_z$ apart so that for the above-mentioned illustrative frequency range, 123 filters would be required. Each filter 12, with incorporation of a full wave rectifier and low pass filter, produces an output voltage proportional to the amplitude of the speech signal within the frequency band to which the filter is tuned. This voltage is applied to a corresponding sample and hold circuit 24 which stores the voltage for some predetermined sampling interval. At the beginning of the next sampling interval, determined by a clock 28, the voltage stored in each sample and hold circuit 24 is "erased" to make ready for receipt of the next voltage from the corresponding filter. Sample and hold circuits suitable for performing the function of the circuits 24 are well known in the art.

Logic circuit 32 is coupled to each of the sample and hold circuits 24 for reading out the stored voltage signals at the predetermined intervals determined by the clock 28. The logic circuit 32 analyzes these voltages to determine which voltages represent peak amplitudes or amplitudes closest to the formant amplitudes of the speech signal in question. The filters 12, in effect, produce a plurality of voltage signals representing the frequency spectrum at clocked timing intervals of a speech signal and this spectrum is analyzed by the logic circuit 32 to determine the formant amplitudes of the spectrum. Of course, when the formant amplitudes are determined, then the formant frequencies are also determined since the filter producing the formant amplitudes corresponds to the desired formant frequencies.

If it were desired that the three largest formants be used in the system of FIG. 3, then the logic circuit 32 would identify three of the filters 12 whose frequencies are nearest the formant frequencies of the three largest formants. Suitable logic circuits for performing the functions of logic circuits 32 are available from Signetics, Corp. and are described in *Signetics Digital, Lineal, MOS Data Book*, published by Signetics, Corp.

The information as to the formant frequencies and amplitudes at each time interval is supplied by the logic circuit 32 to a control circuit 36 which simply utilizes this information to energize or turn on specific ones of sine oscillators 40 and to control the amplitudes of the sine waves produced. Each oscillator 40 corresponds to a different one of the filters 12 but produces a sine wave signal having a frequency of, for example, one-fourth the frequency of the corresponding filter. The oscillators 40 energized by the control circuit 36 correspond to the filters 12 identified by the logic circuit 32 as representing the formant frequencies. Thus, the energized oscillators 40 produce sine wave signals having frequencies of, for example, one-fourth those of the formant frequencies of the speech signal being analyzed.

The particular oscillators 42 which are energized are energized to produce sine wave signals having amplitudes which are some function of the formant amplitudes determined by the logic circuit 32. The amplitudes of the sine wave signals may be some value greater or less than the corresponding formant amplitudes, the same as the formant amplitudes, or some of the sine wave amplitudes may be greater or less than the corresponding formant amplitudes while other of the sine wave amplitudes may be the same as the corresponding formant amplitudes. As indicated earlier, the relative amplitudes of the sine wave signals are determined on the basis of the relative amplitudes of the formants and the individual user's audiogram. The control circuit 36 is simply a translator or decoder for decoding the information received from the logic circuit 32 to produce control signal outputs for controlling the operation of oscillators 40.

The outputs of the oscillators 40 are applied to a summing circuit 44 where the sine waves are combined to produce a single output signal representing all of the "transformed" formants selected.

The pitch detector 16 determines fundamental frequency if a well-defined pitch period exists in the input speech signal as in voiced speech sounds or in sounds which are a mixture of voiced and fricative sound. The pitch detector 16 supplies information to control logic circuit 56 identifying the fundamental frequency of the input speech signal (assuming it has one).

The voiced/unvoiced detector 20 determines whether the speech signal is voiced, unvoiced or mixed. If the speech signal is voiced or mixed, the detector 20 so signals the control logic 56 which then activates a variable frequency oscillator 58 to produce a sine wave signal having a frequency some predetermined amount less than the fundamental frequency indicated by the pitch detector 16. If the speech signal is unvoiced or mixed, then the detector 20 signals a gate 60 to pass a low pass filtered noise signal from a noise generator 64 to a modulator 72. This noise signal modulates the output of the summing circuit 44.

The outputs from the modulator 72 and the oscillator 58 (unless the oscillator 58 has no output because only unvoiced speech was detected) are applied to a summing circuit 46 and the resultant is applied to a variable gain amplifier 48 and then to an acoustical transducer 52. Information in the original speech signal that the signal is voiced, unvoiced or mixed is thus included in the transformed signals and made available to a hearing impaired person.

Control logic circuit 56, gate circuit 60 and noise generator 64 consists of conventional circuitry.

A gain control circuit 68 is coupled to the variable gain amplifier 48 and is controlled by the output of r.m.s. amplitude detector 22 and by a manually operable control 69 to vary the gain of the amplifier. The gain control circuit 68 provides an input to the amplifier 48 to control the gain thereof and thus the volume of the acoustical transducer 52. The volume of the transducer increases or decreases with the r.m.s. amplitude and the overall volume may be controlled by the user via the manual control 69.

The clock 28 provides the timing for the system of FIG. 3 (as does clock 128 for the system of FIG. 2) by signalling the various units indicated to either sample the speech signal or change the output parameters of the units. An exemplary sampling time or sampling interval is 10 m sec. (0.01 sec.) but other sampling intervals could also be utilized.

Both hard-wired digital and analog embodiments have been described for implementing the method of the present invention. The method may also be implemented utilizing a programmable digital computer such as a PDP-15 digital computer produced by Digital Equipment Corporation. If a digital computer were utilized, then the computer would, for example, replace all hard-wired units shown in FIG. 2 except the microphone 104, amplifier 108, analog to digital converter 110, digital to analog converter 168, gain control unit 164 and speaker 172. The functions carried out by the computer would correspond to the functions performed by the different circuits shown in FIG. 3. Methods of processing speech signals to determine formant frequencies and amplitudes, to determine r.m.s. amplitudes, to determine pitch and to determine whether or not a speech signal is voiced or unvoiced are well known. See, for example, the aforecited Christensen et al reference; Oppenheim, A. V., "Speech Analysis-Synthesis System Based on Homomorphic Filtering", *The Journal of the Acoustical Society of America*, Volume 45, No. 2, 1969; Markel, J. D., "Digital Inverse Filtering-A New Tool for Formant Trajectory Estimation", *I.E.E.E. Transaction on Audio and Electoacoustics*, June 1972; Dubnowski et al, "Real-Time Digital Hardware Pitch Detector", *I.E.E.E. Transactions on Acoustics, Speech, and Signal Processing*, February 1976; and Atal et al, "Voiced-Unvoiced Decision Without Pitch Detection", *J. Acoust. Soc. of Am.*, 58, 1975, page 562.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A hearing aid system comprising means for receiving a vocal speech signal, an analog to digital converter coupled to said receiving means, an analyzer means coupled to said converter for producing signals representative of the spectral envelope of said speech signal at predetermined intervals therein, logic means for processing the signals produced by said analyzer means and for producing, at said intervals, frequency signals representing the frequencies $F_n$ of n formants of the speech signal, means for reducing said frequency signals by some predetermined value to obtain frequency signals $F'_n$, a plurality of sound generators adapted to produce digital information representing oscillatory signals having frequencies $F'_n$, means for combining said digital information representing said oscillatory signals to produce an output signal, a digital to analog converter coupled to said combining means, and transducer means for producing an auditory signal from the output signal of said digital to analog converter.

2. A hearing aid system as in claim 1 wherein said signal reducing means includes divider means for dividing the frequency signals by some predetermined values to obtain frequency signals $F'_n$.

3. A hearing aid system as in claim 2 wherein said divider means is adapted to divide the frequency signals representing the frequencies $F_n$ by a value of from two to six.

4. A hearing aid system as in claim 2 wherein said divider means includes adder means for adding a predetermined value to the frequency signals $F'_n$.

5. A hearing aid system as in claim 2 further comprising means coupled to said analog to digital converter for determining, at said intervals, the fundamental frequency $F_o$ of the speech signal, wherein said logic means is adapted to produce, at said intervals and in response to said fundamental frequency determining means, another frequency signal representing the fundamental frequency $F_o$, wherein said divider means is adapted to divide said another frequency signal by a predetermined value to obtain a frequency signal $F'_o$, and wherein said oscillatory signal producing means includes another sound generator adapted to produce digital information representing an oscillatory signal having a frequency $F'_o$ for application to said combining means.

6. A hearing aid system as in claim 5 wherein said divider means is adapted to divide the frequency signal representing the frequency $F_o$ by some value less than the value by which the frequency signals representing the frequencies $F_n$ are divided.

7. A hearing aid system as in claim 5 further comprising detector means for determining, at said intervals, the r.m.s. amplitude $A_o$ of the speech signal, and wherein said another sound generator is adapted to produce digital information representing an oscillatory signal having an amplitude $A'_o$ which is a function of amplitude $A_o$.

8. A hearing aid system as in claim 2 further comprising a sound detector coupled to said analog to digital converter for producing, at said intervals, sound indicator signals which indicate if the speech signal is voiced or unvoiced, and control means responsive to said sound indicator signals for producing first control signals when the speech signal is voiced and second control signals when the speech signal is unvoiced, and wherein at least certain of said sound generators are adapted to produce, in response to said second control signals, digital information representing noise signals.

9. A hearing aid system as in claim 8 wherein said oscillatory signal producing means includes sound generators adapted to produce digital information representing oscillatory signals having frequencies $F'_n$ in response to said first control signals, and to produce digital information representing narrow band noise signals centered at frequencies $F'_n$ in response to said second control signals.

10. A hearing aid system as in claim 2 wherein said logic means is adapted to process the signals produced by the analyzer means to produce, at said intervals, amplitude signals representing the amplitudes $A_n$ of said $n$ formants of the speech signal, wherein said estimating means further includes an amplitude compressor means coupled to said logic means for modifying the amplitude signals $A_n$ by a predetermined amount to obtain amplitude signals $A'_n$, and wherein said sound generators are adapted to produce digital information representing oscillatory signals having amplitudes $A'_n$.

11. A hearing aid system as in claim 10 wherein said amplitude compressor means is adapted to divide the amplitude signals $A_n$ by a predetermined value and to add thereto another predetermined value to obtain amplitude signals $A'_n$.

12. A hearing aid system as in claim 2 further comprising a gain control means coupled between said combining means and said digital to analog converter for controlling the gain of said output signal.

13. A hearing aid system comprising means for receiving a vocal speech signal, a plurality of band pass filters coupled to said receiving means, each for producing, at predetermined intervals in the speech signal, a signal whose amplitude represents the amplitude of the speech signal in a given frequency range different from the frequency ranges of the other filters, logic means coupled to said filters for producing, at said intervals, signals identifying the $n$ filters which produced the signals having peak amplitudes corresponding to the amplitudes $A_n$ of $n$ formants of the speech signal, a plurality of oscillators, each adapted to produce an oscillatory signal having a frequency of some predetermined value less than the frequency range of a corresponding one of said filters, control means responsive to the signals produced by said logic means for energizing, at said intervals, selected oscillators corresponding to the filters identified by the signals, means for combining said oscillatory signals to produce an output signal, and transducer means for producing an auditory signal from said output signal.

14. A hearing aid system as in claim 13 wherein said oscillators are each adapted to produce an oscillatory signal having an amplitude determined by the value of the input control signal, and wherein said control means is adapted to apply input control signals to the selected oscillators, the value of an input control signal applied to a particular oscillator being a function of the amplitude of the signal produced by the corresponding filter.

15. A hearing aid system as in claim 13 further comprising means coupled to said receiving means for producing a first signal if, at a given interval, the speech signal includes unvoiced sound, and for producing a second signal if, at the given interval, the speech signal includes voiced sound, a modulator means coupled to the output of said combining means, a noise signal generator, gate means responsive to said first signal for gating a noise signal from said noise signal generator to said modulator means for noise modulating the output signal of said combining means, and means for applying the modulated signal to the transducer means.

16. A hearing aid system as in claim 15 further comprising means for determining, at said intervals, the fundamental frequency of the speech signal, second signal combining means coupled between said modulator means and said transducer means, a variable frequency oscillator coupled to said second combining means, and control means responsive to said second signal and to said fundamental frequency determining means for causing said variable frequency oscillator to produce an oscillatory signal having a frequency some value less than the fundamental frequency determined by the determining means.

17. A hearing aid system as in claim 13 further comprising detector means for detecting, at said intervals, the r.m.s. amplitude of the speech signal, and gain control means coupled between said combining means and said transducer means and responsive to said amplitude detector means for adjusting the gain of said output signal in accordance with the r.m.s. amplitude.

* * * * *